US009000282B1

(12) United States Patent
Booth

(10) Patent No.: US 9,000,282 B1
(45) Date of Patent: Apr. 7, 2015

(54) GUITAR BRACING

(71) Applicant: Jason Booth, Athens, GA (US)

(72) Inventor: Jason Booth, Athens, GA (US)

( * ) Notice: Subject to any disclaimer, the term of this patent is extended or adjusted under 35 U.S.C. 154(b) by 0 days.

(21) Appl. No.: 14/109,182

(22) Filed: Dec. 17, 2013

(51) Int. Cl.
*G10D 3/02* (2006.01)
*G10D 1/08* (2006.01)

(52) U.S. Cl.
CPC ... *G10D 1/08* (2013.01); *G10D 3/02* (2013.01)

(58) Field of Classification Search
CPC ..... G10D 3/02; G10D 1/08
See application file for complete search history.

(56) References Cited

U.S. PATENT DOCUMENTS

| | | | | | |
|---|---|---|---|---|---|
| 155,353 | A * | 9/1874 | White | 84/276 |
| 605,942 | A * | 6/1898 | White | 84/276 |
| 661,412 | A * | 11/1900 | Lowenthal | 84/276 |
| 1,635,502 | A * | 7/1927 | Redlinger | 84/274 |
| 1,881,311 | A * | 10/1932 | Doe Currier et al. | 84/275 |
| 2,473,980 | A * | 6/1949 | Willner | 84/271 |
| 3,014,394 | A * | 12/1961 | Szymanski | 84/276 |
| 3,443,465 | A * | 5/1969 | Kasha | 84/267 |
| 3,656,395 | A * | 4/1972 | Kaman | 84/267 |
| 3,685,385 | A * | 8/1972 | Rendell | 84/267 |
| 3,892,159 | A * | 7/1975 | Houtsma | 84/307 |
| 4,079,654 | A * | 3/1978 | Kasha | 84/291 |
| 4,084,475 | A * | 4/1978 | Horowitz | 84/291 |
| 4,429,608 | A * | 2/1984 | Kaman et al. | 84/291 |
| 4,836,076 | A * | 6/1989 | Bernier | 84/275 |
| 4,881,441 | A * | 11/1989 | Larsen | 84/291 |
| 5,469,770 | A * | 11/1995 | Taylor | 84/291 |
| 5,952,592 | A * | 9/1999 | Teel | 84/291 |
| 6,166,308 | A * | 12/2000 | Lam | 84/291 |
| 6,943,283 | B2 * | 9/2005 | McPherson | 84/291 |
| 7,166,788 | B2 * | 1/2007 | Wyman | 84/291 |
| 7,301,085 | B2 * | 11/2007 | Wyman | 84/291 |
| 7,439,427 | B2 * | 10/2008 | Kroeger et al. | 84/291 |
| D581,970 | S * | 12/2008 | Park | D17/20 |
| D592,697 | S * | 5/2009 | Park | D17/20 |
| 7,612,271 | B1 * | 11/2009 | Davis et al. | 84/267 |
| 7,790,970 | B2 * | 9/2010 | McPherson | 84/291 |
| 8,378,191 | B2 * | 2/2013 | Barillaro | 84/267 |
| 8,450,587 | B2 * | 5/2013 | McPherson | 84/291 |
| 8,618,387 | B2 * | 12/2013 | McPherson | 84/291 |
| 8,729,371 | B2 * | 5/2014 | Yokoyama | 84/173 |
| 2005/0109188 | A1 * | 5/2005 | Park | 84/294 |
| 2005/0120859 | A1 * | 6/2005 | England | 84/290 |
| 2008/0000342 | A1 * | 1/2008 | Menduina Fernandez | 84/291 |
| 2009/0007752 | A1 * | 1/2009 | Kroeger et al. | 84/291 |
| 2012/0097007 | A1 * | 4/2012 | Barillaro | 84/291 |

* cited by examiner

*Primary Examiner* — Robert W Horn
(74) *Attorney, Agent, or Firm* — Stephen J. Stark

(57) ABSTRACT

A guitar has improved bracing. Specifically, some embodiments have radial main braces which do not intersect a center of a bridge plate. Some embodiments have radial main braces which are connected by web braces. Some embodiments have suspended main braces extending from the bridge plate.

19 Claims, 3 Drawing Sheets

GUITAR BRACING

FIELD OF THE INVENTION

The present invention relates to a bracing for use with guitars, and more particularly to bracing utilized with guitar sound boards such as tops or even bottoms and more preferably to guitar soundboards having a spider-web style bracing system.

BACKGROUND OF THE INVENTION

"X" style bracing has been utilized by Martin Guitar Company for well over one hundred years. This style bracing involves an X with the intersection typically located below a symmetrically disposed sound hole and above a bridge plate. The legs of the X form a 90° angle where the members intersect. It is estimated that approximately 90% of all steel stringed acoustic guitars utilize an "X" style bracing system, possibly with enhancement such as X-1 bracing and A-frame X bracing. An angled bridge plate and/or one or more angled braces from the bottom legs of the X may be provided which do not extend to a side. Above the intersection of the X may be an A-frame brace which typically proceeds perpendicularly from the upper legs of the X with a ladder lateral support above the sound hole extending from edge to edge of the soundboard. The top intersection of the A almost touches the head block.

With classical guitars there are a number of other bracing styles which are utilized. There is ladder bracing which involves bracing struts extending from edge to edge of the body perpendicular to the grain of the sound board (i.e., usually perpendicular to the string direction). There is also fan bracing of various styles in which struts extend radially outwardly generally below a sound hole, but starting above the bridge location. These designs often provide two ladder style struts extending above and below the sound hole and are not known by the applicant to use bridge plates.

Lattice bracing has also been utilized for bracing in guitar constructions which includes intersecting braces which form a mesh of a lattice construction while intersecting sets of parallel disposed braces.

While there are variations in the market place, approximately 90% of all steel string guitars such as those provided by Martin Guitar Company and others are believed to be X style bracing variations.

Accordingly, there is believed to be a need for an improved bracing configuration.

Another need is believed to exist for an improved bracing.

SUMMARY OF THE INVENTION

Accordingly, it is an object of many embodiments of the present invention to provide improved bracing configuration to enhance the sound of at least some guitar embodiments.

For at least some embodiments, there may not be a ladder style brace which extends completely perpendicular from edge to edge of a sound board of the guitar.

In fact, many embodiments of the present invention provide a spider web style construction which is somewhat similar to a radial construction, but at least one difference may be that a "middle" of the spider web begins at a bridge plate opposite the bridge and extends radially outward preferably for at least several of the braces to an edge of the soundboard. Many braces may extend up and down or left and right (i.e., in the same direction or perpendicular direction to the strings respectively). Each main brace preferably begins at the bridge plate and extends radially outward directed from the bridge plate, some of which may intersect a center or centroid of the ridge plate. There are also embodiments in which additional main braces begin at the bridge plate, but do not necessarily intersect at the center or centroid of the bridge plate, but do extend outwardly to the guitar edge or sides.

Many embodiments of main braces may take a variety of forms including being a suspension style brace in that at least one-third of the brace does not contact the bottom of the sound board, but is instead suspended below it for a portion of the brace. In fact, for many embodiments, the suspension area or gap extends from about the mid-point of the brace to just before the bridge plate where it contacts the bottom surface of the bridge plate. The gaps of the main braces can cooperate to form areas where the sound board is not connected for at least ¼, ⅓, or up to about ½ of a circumference about the bridge plate. With suspended side braces, the gaps could circumnavigate the bridge plate for some embodiments.

Connected to the main braces for many embodiments whether they be suspension or fixed (along their entire length to the sound board) preferably are at least some web braces which extend between adjacent main braces, preferably acutely angled thereto to both main braces with the acute angles facing the sound board. Side braces generally extend perpendicular to the strings to the edges and are preferably not ladder style brace, but instead preferably are separated from one another. The bridge plate provides a location where the main braces and side braces join at spaced apart locations. The main braces are also preferably connected to the bottom of the sound board.

Many embodiments lack lateral ladder style bracing, while retaining strength provided through the "web" style bracing and providing improved tonal characteristics with the guitar. Additionally, utilizing a radial style bracing which is not a conventional radial construction for at least some embodiments, at least some of the main braces can be diagonally oriented main braces which do not intersect at a center or centroid of the bridge plate where the lateral and longitudinal main braces intersect. Furthermore, the web braces are preferably acutely angled relative to main braces which is believed to be novel with adjacent main braces.

While many embodiments do not have any ladder style braces extending from side to side, other embodiments may.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
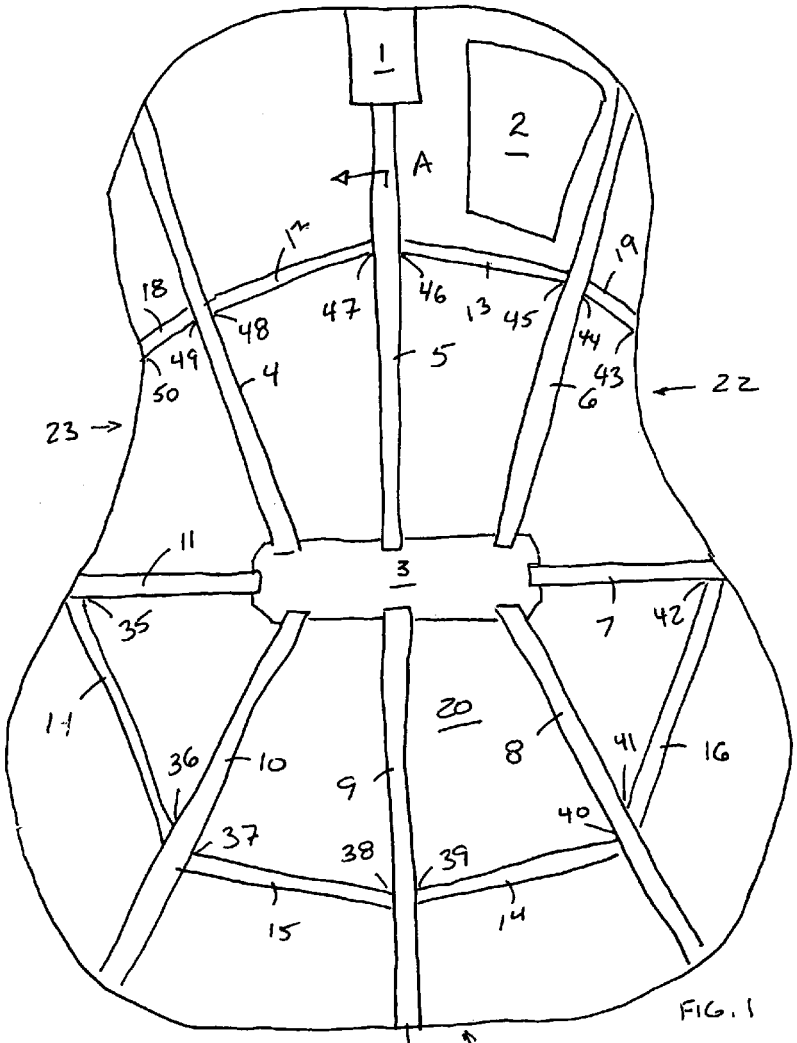
FIG. 1 is a bottom plan view of the underside of a soundboard of a guitar with the braces installed in accordance with a presently preferred embodiment of the present invention.

FIG. 1 shows a bottom plan view of a sound board 21 of a guitar 30 (shown in FIG. 8) of a presently preferred embodiment of the present invention with bracing installed. Sound boards 21 could be a top or bottom of a guitar body, but many embodiments of the presently preferred embodiment provides the sound board 21 as the top.

The soundboard 21 is preferably connected to a head block 1 and often times includes a bridge plate 3. Sound hole 2 may take various configurations and/or positions such as the asymmetric configuration and/or position illustrated, or others such as a traditional symmetrically disposed round hole, etc. In fact, upper vertical main brace 5 may be omitted such as in constructions having an traditional symmetrically disposed sound hole and/or other provided for various embodiments. Alternatively, this brace 5 could take various forms to accommodate various constructions for various embodiments.

Nevertheless, for the presently preferred embodiment, main brace 5 is provided upwardly and downwardly relative to side brace(s) 7 and 11 as discussed below along with the other main braces 4, 6, 8, 9 and 10 which preferably extend radially outwardly away from centrally disposed bridge plate 3. Bridge plate 3 extending laterally longer than from top 24 to bottom 25 of the guitar body 31 for many embodiments. The vertical main braces 5 and 9 extend parallel to strings 32 as would also be understood by those of ordinary skill in the art. The upper and lower vertical main braces 5,9 preferably do not connect together, but are separated or connect to bridge plate 3 to be separated from one another. Vertical main braces 5 and 9 extend radially away from bridge plate 3 such as to contact the head block 1 and/or the tail block 27 or not respectively. Main braces 4,6,8 and 10 also extend radially away from bridge plate 3 but do not extend through a center or centroid of the bridge plate 3 as the illustrated upper and lower main vertical braces 5 and 9 do in a preferred embodiment and connect for many embodiments to lining 28. Other embodiments may not contact lining 28 with main braces 4,6,8 and/or 10.

Side brace(s) 7,11 also are illustrated extending linearly and radially away from a center and/or bridge plate 3 illustrated and extend to the edges 22,23 respectively and may connect to lining 28. With many embodiments, side braces 7,11 are continuously connected to bottom surface 20 of the sound board 21 and in other embodiments may be suspended, at least partially as the main braces 4,5,6,8,9 and 10 may be in many embodiments as described below.

Figure 2:
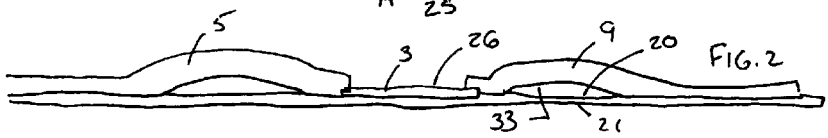
FIG. 2 is a side cross sectional view taken along the line A-A of FIG. 1.
Figure 3:
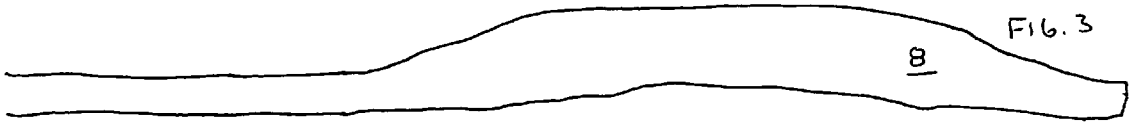
FIG. 3 is a side plan view of a main brace of a presently preferred embodiment of the invention as used in FIGS. 1-2.

Referring to FIG. 2, the main braces 4,5,6,8,9 and 10 are linear and are shown as being "suspension" braces which are shown in better detail with reference to FIGS. 2 and 3. The braces 4-6, 8-10 are shown connecting to the bridge plate 3 such as at bottom surface 26 of the bridge plate 3 as well as to the bottom surface 20 of the sound board 21 before contacting the bridge plate 26. For at least about one quarter or even about one-third of the length of the braces 4-6 and 8-10, the respective brace 4-6 and 8-10 may be suspended or spaced below the bottom surface 20 of the sound board 21 by a gap 33. For many embodiments, no more than about one-half of the length of the main braces 4-6 and 8-10 are suspended by gap 33. The gaps 33 of the main braces 4-6 and/or 8-10 may cooperate to extend an arc about the sound plate for at least about ¼, ⅓ or even up to ½ of a circumference about the bridge plate 3. Since embodiments may have gaps 33 in the side braces 7,11 to circumnavigate the bridge plate 3. The sound board 3 for many embodiments aids in the strength of the bracing.

Then the remaining portions the braces 4-6 and 8-10 connect to the back to the bottom surface 20 of sound board 21 so that web braces 12-17 can then connect adjacent main braces 4-6, 8-10 together where connected to the sound board 21, for at least the presently preferred embodiment. Web braces 18,19 connect the main braces 4 and 6 respectively to the edges 22 and 23 for the preferred embodiment such as to the lining 28.

As can be seen from the preferred embodiment of FIG. 1, the web braces 12-19 are shown as linear and preferably connect at acute angles to the main braces 4-6 and 8-10 at connections 37-40 and 45-48 where the acute angles face the bridge plate 3 (or under of the sound board 21). Furthermore, the angle is acute with the web braces 18,19 where they connect to the edges 22,23 and main braces 4,6,8 and 10 as well for the preferred embodiment at the connections 35,36, 41,44,49 and 50. Other embodiments may have different constructions. Connections 36-41 and 44-49 are preferably provided in oppositely disposed pairs about respective main braces 4-6 and 8-10 at specific locations along those main braces 4-6 and 8-10. Many of the web braces 12-19 are shown spaced from the bridge plate 3 and the edges 22,23 for the preferred embodiment.

Side braces 7 and 11 may be somewhat similar in construction to the main braces 4-6 and 8-10 as they extend from the bridge plate 3 to the edges 22,23 or to the top 24 and/or the bottom 25 with the side braces 7,11 preferably connected continuously to the bottom surface 20 of the sound board 21 for the preferred embodiments. Other embodiments may have different constructions.

The web braces 12-19 preferably connect continuously (i.e., fixed) to the bottom surface 20 of sound board 21. At least a portion also could be suspended for at least some embodiments.

Figure 4:
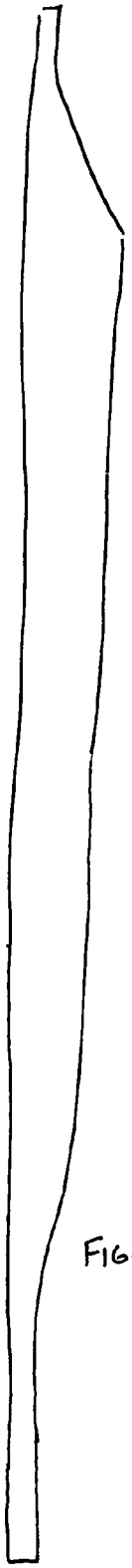
FIG. 4 is a side plan view of a first alternatively preferred main brace of FIG. 3.
Figure 5:
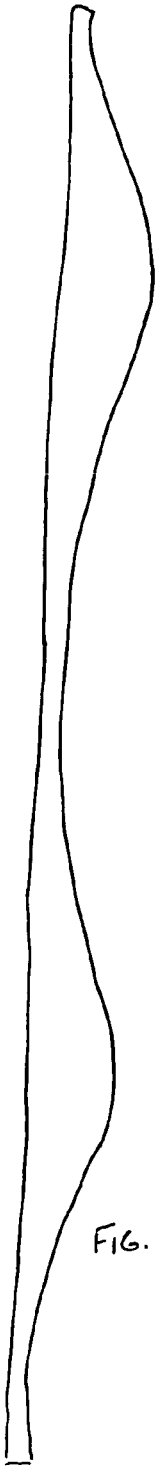
FIG. 5 is a side plan view of a second alternatively preferred embodiment of the main brace of FIG. 3.
Figure 6:
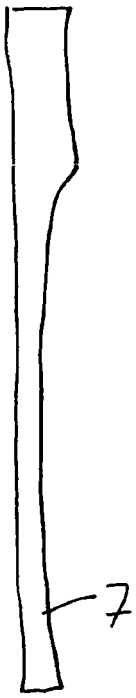
FIG. 6 is a side plan view of a presently preferred embodiment of a side brace.
Figure 7:
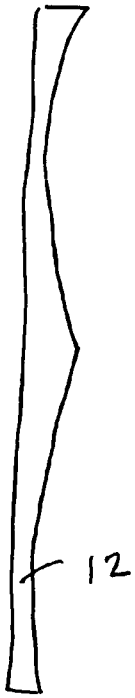
FIG. 7 is a side plan view of a presently preferred embodiment of a web brace as is shown in FIG. 1.

Furthermore, the web braces 12-19 and/or other braces could be scalloped such as double scalloped as illustrated in FIG. 7 or single scalloped such as the side brace(s) 7,11 for (at least some embodiments) as shown in FIG. 6. As shown in FIGS. 4 and 5 for alternate embodiments, a fixed (rather than suspension) brace may be utilized for the main braces 4-6 as well as 8-10 as shown in FIG. 5 as alternative embodiments with scalloping to lighten the weight, change tone, and/or provide sufficient strength.

Figure 8:
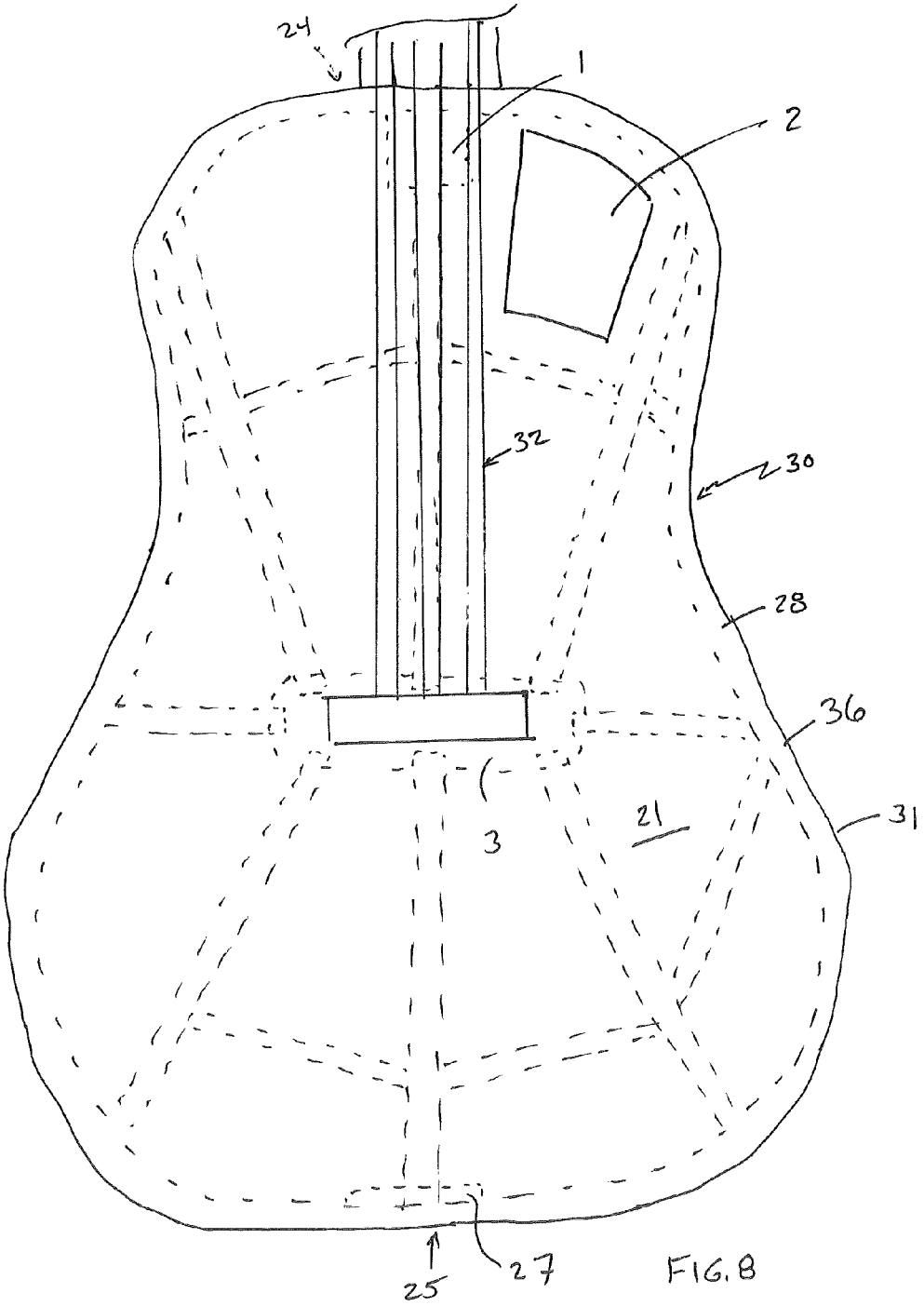
FIG. 8 is a plan view of a top portion of a guitar showing bracing and internal structure in phantom therein.

As shown in FIG. 8, the upper vertical main brace 5 may connect to the head block from the lower main vertical brace 9 may connect to the tail block 28 as opposed to various portions of the sides as illustrated in the preferred embodiment for other locations.

Main braces 4-6, 8-10 are illustrated not connected to the sound board 21 where suspended as well as connected at the bottom of the bridge plate 3 and at the sound board 21 before contacting the sound board 3 to facilitate connection to the top or sound board of guitars 30.

While variations of bracing 4-7, 8-10 are known in the art as described above, there is no known use of main bracing as is known or described herein. There is also no known omission of all ladder style braces (extending laterally continuously from side edge to side edge).

There is also no known brace construction of radial style bracing suspended at least partially from a sound board 21 to a web brace which extends acutely between adjacent main braces. There is no known radially extending braces for at least some embodiments, in which the vertical main bracing and side bracing extend parallel and perpendicular to the string direction respectively while additional main bracing 4,6,8,10 extends from a bridge plate 3 radially to edges 22,23 without do not intersect the intersection of the side braces 7,11 and vertical main braces 5,9. The suspension embodiments are also believed to be novel.

There is also no known bracing system in which a radial style bracing is provided in the form of a spider-web style with web bracing 12-19 spaced from the center of a radial structure and connected at acute angles to the main bracing 4-6, 8-10, preferably connected to the bottom surface 20 of the sound board 21.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A guitar with improved bracing comprising:

a body having a sound board connected at a bridge to strings;

a bridge plate opposite the sound board from the strings;

at least first and second radially extending main braces extending from the bridge plate toward edges of the sound board, said first and second main braces defining lines which are not collinear with a centroid point of the bridge plate; and wherein at least ¼ of a length of the first and second main braces are suspended by a gap from a bottom surface of the sound board.

2. The guitar of claim 1 wherein the first and second main braces are connected with a web brace spaced from the bridge plate and the edges of the sound board.

3. The guitar of claim 2 wherein the web brace connects at first and second connections to the first and second main braces, respectively at acute angles relative to the bridge plate.

4. A guitar with improved bracing comprising:

a body having a sound board connected at a bridge to strings;

a bridge plate opposite the sound board from the strings;

at least first second and third radially extending main braces extending from the bridge plate toward edges of the sound board, said first and second main braces connected with a first web brace spaced from the bridge plate and the edges of the sound board and acutely angled relative to the bridge plate at a first connection; and said second and third main braces connected with a second web brace spaced from the bridge plate and the edges of the sound board and acutely angled relative to the bridge plate at a second connection.

5. The guitar of claim 4 wherein main and web braces are linear.

6. The guitar of claim 5 wherein the first second and third main braces are suspended by a gap over a portion of their respective lengths from a bottom surface of the soundboard.

7. The guitar of claim 6 wherein the first second and third main braces are suspended by a gap for at least ¼ of their respective lengths from a bottom surface of the soundboard.

8. The guitar of claim 6 wherein the first and second connections are oppositely disposed at a location on the second main brace.

9. The guitar of claim 8 wherein first second connections are located adjacent to a bottom surface of the sound board.

10. The guitar of claim 4 wherein the first and second connections are oppositely disposed at a location on the second main brace.

11. The guitar of claim 10 wherein first second connections are located adjacent to a bottom surface of the sound board.

12. The guitar of claim 4 wherein the first second and third main braces are suspended for no more than ½ of a length of each of the first second and third main braces.

13. The guitar of claim 12 wherein the first, second and third main braces are connected to the sound board opposite a gap created by suspended portions of each of the first second and third main braces.

14. The guitar of claim 13 wherein the gap is spaced from the sound board.

15. The guitar of claim 4 wherein the sound hold is asymmetrically disposed relative to the sound board.

16. The guitar of claim 4 wherein the second main brace is parallel to the strings.

17. A guitar with improved bracing comprising:

a body having a sound board connected at a bridge to strings;

a bridge plate opposite the sound board from the strings;

at least first and second radially extending main braces extending from the bridge plate toward edges of the sound board, said first and second main braces suspended and spaced by a gap for at least ¼ of a length of the main braces from the sound board.

18. The guitar of claim 17 wherein the gap is no more than ½ the length of the main braces and a web brace connects the first and second main braces at acute angles relative to the bridge plate.

19. The guitar of claim 17 wherein the main braces do not intersect a center point of the sound board.

* * * * *